United States Patent [19]

Dudley

[11] Patent Number: 4,803,881

[45] Date of Patent: Feb. 14, 1989

[54] PIPE STRETCHING APPARATUS

[76] Inventor: Winfred L. Dudley, 2409 Dehesa Rd., El Cajon, Calif. 92021

[21] Appl. No.: 9,454

[22] Filed: Feb. 2, 1987

[51] Int. Cl.[4] ..... B21D 51/14

[52] U.S. Cl. ..... 72/392; 72/370

[58] Field of Search ..... 72/392, 705, 403, 370, 72/381, 393

[56] References Cited

U.S. PATENT DOCUMENTS

| | | | |
|---|---|---|---|
| 2,916,076 | 12/1954 | Young | 72/392 |
| 3,625,046 | 12/1971 | Gompel | 72/705 |
| 3,710,609 | 1/1973 | Jones | 72/392 |
| 3,996,783 | 12/1976 | Messerole | 72/392 |
| 4,027,522 | 6/1977 | Clavin | 72/392 |
| 4,571,980 | 2/1986 | Goodwin | 72/392 |

FOREIGN PATENT DOCUMENTS

| | | | |
|---|---|---|---|
| 387335 | 12/1923 | Fed. Rep. of Germany | 72/392 |

*Primary Examiner*—David Jones

*Attorney, Agent, or Firm*—Brown, Martin, Haller & Meador

[57] ABSTRACT

An apparatus for stretching pipe having first and second elongated mandrels each having a longitudinal axis and an outer surface of a predetermined cross-section transverse to the longitudinal axis of each mandrel. A displacement system is included for adjusting the relative distance between the mandrels. A cylindrical spiral ribbed pipe is positioned lengthwise over the mandrels with the mandrels fitting against the inner wall of the pipe. The displacement system increases the relative distance between the mandrels so as to reform the original circular end cross-sectional shape of the pipe.

10 Claims, 2 Drawing Sheets

PIPE STRETCHING APPARATUS

BACKGROUND OF THE INVENTION

I. Field of the Invention

The present invention relates to a device for stretching pipe. More specifically, the present invention relates to a novel and improved apparatus for stretching spiral ribbed pipe having a circular end cross-section into pipe having an elliptical or oval end cross-section.

II. Background Art

Heating and air condition installations in commercial buildings have typically used the conventional rectangular or square flat wall ducting or pipe for conducting air to and from locations within the building. The size of the ducting is chosen according to the building air flow design specifications. The rectangular ducting is the most commonly used in commercial application. This type of flat wall ducting must have a wall thickness sufficient to maintain structural integrity and the rectangular cross-section of the ducting than cylindrical ducting. In addition, the rectangular or square ducting has a larger surface area than cylindrical ducting so that more metal is used in the manufacture of rectangular or square ducting than the cylindrical ducting. The increase in wall thicknesses and surface are translated in the requirement that more be used in the manufacture of rectangular or square ducting than that in cylindrical ducting. Coupled with the additional manufacturing difficulty in fabricating rectangular ducting, this type of ducting is more expensive than comparable cylindrical ducting.

In many applications it is desirable to use a corrugated cylinder ducting which requires less metal in its manufacture and is, therefore, less expensive. Less metal is required in corrugated cylindrical ducting because of the less surface area and thinner walls which may be used since the ribs increase structural support. In addition, the corrugated cylindrical ducting requires less labor in its manufacture. Although the construction of the cylindrical spiral ribbed ducting is advantageous on a cost per foot basis, its cross-sectional shape limits its use in many applications where only rectangular or square ducting would fit.

It is, therefore, an object of the present invention to provide an apparatus for stretching spiral ribbed ducting having a cylindrical cross-section into ducting having an oval or elliptical cross-section.

SUMMARY OF THE INVENTION

The present invention is an apparatus for stretching the wall of a cylindrical spiral ribbed pipe in a direction transverse to the longitudinal axis of the pipe. The apparatus includes a first elongated mandrel having an outer surface substantially concave in cross-section transverse to a longitudinal axis of rotation of the mandrel. A second elongated mandrel is included which has an outer surface substantially concave in cross-section transverse to a longitudinal axis of rotation of the second mandrel. The first and second mandrel longitudinal axes are parallel to one another with the first and second mandrel outer surfaces facing away from one another. A displacement means adjusts the relative distance between the first and second mandrels. A pipe of cylindrical cross-section is positioned lengthwise over the mandrels with the outer surfaces of the mandrels facing the inner wall of the pipe. The distance between the mandrel outer surfaces are increased thereby contacting the inner wall of the pipe and reforming the cross-section of the pipe from circular to elliptical or oval. The distance between the mandrels are then reduced with the pipe removed from the apparatus while retaining its reformed cross-section.

BRIEF DESCRIPTION OF THE DRAWINGS

The objects, advantages and features of the present invention will be more fully apparent from the detailed description set forth below, taken in conjunction with the accompanying drawings in which like reference characters correspond throughout and wherein.

DETAILED DESCRIPTION OF THE PREFERRED EMBODIMENTS

Figure 1:
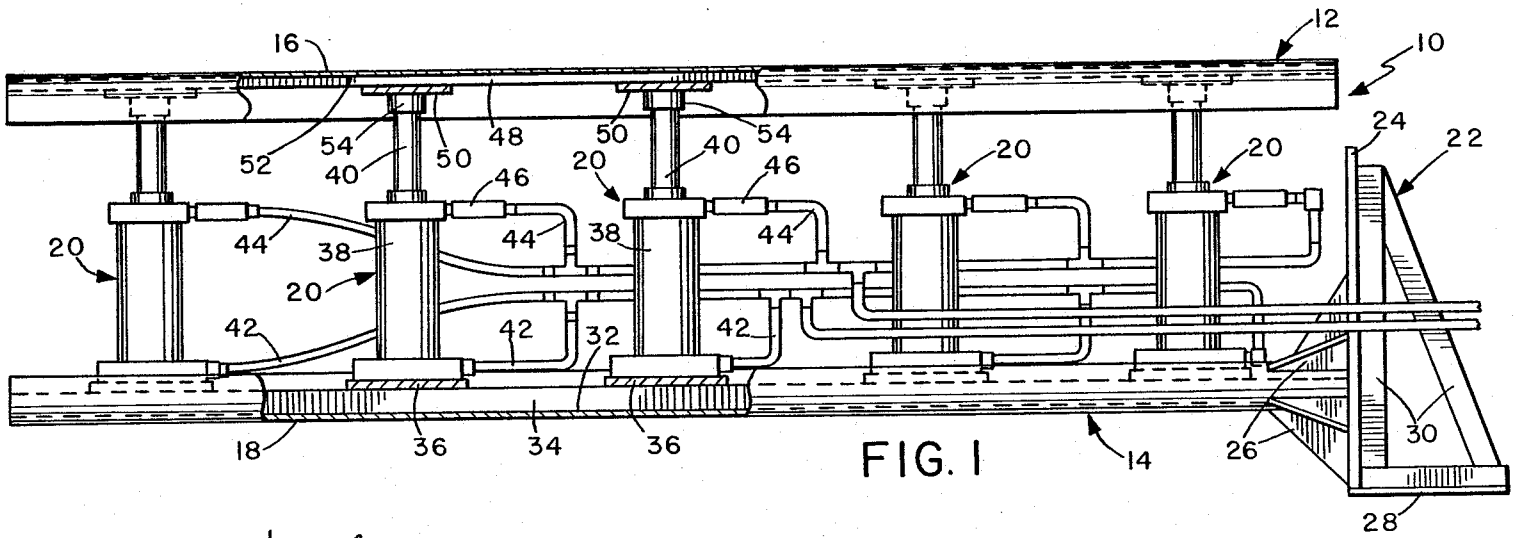
FIG. 1 is a side elevation view of the apparatus, with portions cut away.

FIG. 1 illustrates pipe stretcher 10 in a side elevation view. Pipe stretcher 10 includes top and bottom elongated mandrels 12 and 14 each having a concave cross-section transverse to the longitudinal axis of the mandrels. Outer surfaces 16 and 18, respectively of mandrels 12 and 14 are usually semi-circular in cross-section when viewed from the end such as that illustrated in FIG. 4. Mandrels 12 and 14 are typically constructed of steel or any other rigid, durable material well known in the art. A plurality of hydraulic jacks 20 are disposed between mandrels 12 and 14 for changing the relation of spacing between the mandrels. The number of hydraulic jacks between the mandrels is determined by the pressures required to stretch the pipe.

Mounted at one end of mandrel 14 is support frame 22 for suspending top and bottom mandrels 12 and 14 along with jacks 20 above the ground surface. Support frame 22 suspends the mandrels and jacks above the ground so that a pipe may be slipped over these components for stretching.

Support frame 22 is comprised of a rectangular side plate 24 mounted at one end of mandrel 14 in a plane perpendicular to the longitudinal axis of mandrel 14. A group of triangularly shaped support webs 26 extend radially from and longitudinally along surface 18, adjacent the end mounted support to support frame 22, and interconnect with rectangularly-shaped side plate 24. Mounted perpendicularly to side plate 24 at a bottom edge thereof is bottom plate 28. Bottom plate 28 is rectangularly shaped and extends from side plate 24 in a direction away from mandrel 14. Side plate 24 and bottom plate 28 are fixed in an L-shaped configuration. A reinforcement frame comprised of legs 30 is mounted within the inside portion of the L-shaped configuration and across side and bottom plates 24 and 28. Legs 30 provide additional support to the structure of support frame 22. Support frame 22 is typically constructed of steel members which are welded or secured together by other means well known in the art. The support frame is similarly secured to mandrel 14.

Mounted within the inner surface 32 of mandrel 14 is a runner 34. Runner 34 extends along the length of elongated mandrel 14 in the apex of the convex inner surface of mandrel 14. Runner 34 is typically rectangular in cross-section and is symmetrically positioned in a plane perpendicular to the longitudinal axis of rotation of mandrel 14 and symmetrical to the cross-sectional curvature of outer surface 18.

A plurality of mounting plates 36 are positioned in a spaced apart relationship with respect to one another along runner 34. Mounting plates 36 are mounted perpendicular to runner 34 and is secured to runner 34 and inner surface 32. Runner 34 and mounting plate 36 are typically constructed of a rigid, resilient material such as steel and may be secured together and to the inner surface 32 of mandrel 14 by welding or other means well known in the art.

Mounted upon each mounting plate 36 is hydraulic jack 20 which is comprised of an outer cylinder 38 and an inner piston 40. Coupled to the bottom end of each cylinders 38 is hydraulic feed line 42. Coupled to the top end of each cylinder is hydraulic feed line 44. Hydraulic jacks 20 are typically of a type having a six inch diameter cylinder bore, with a two inch diameter rod mounted within the cylinder and capable of a twelve inch stroke. Coupled between feed line 44 and the top end input to each cylinder 38 is a flow control valve 46. Flow control valve 46 regulates the hydraulic pressure coupled to each hydraulic jack 20 so as to maintain a uniform displacement of piston 40 from jack to jack.

Mounted at an outer end of piston 40 away from cylinder 38 is top mandrel 12. Mandrel 12 is coupled to each piston 40 through runner 48 and mounting plate 50. Runner 48 has a rectangular cross-section and extends along the length of the inner surface 52 of mandrel 12 in the apex of the convex inner surface 52. Runner 48 is located in a plane perpendicular to the longitudinal axis of rotation of mandrel 12 and symmetrical to the cross-sectional curvature of the outer surface 16 of mandrel 12. Mounting plates 50 are positioned in a spaced apart relationship along runner 48 in alignment with pistons 40. Mounting plates 50 and runner 48 are constructed of a rigid, resilient material such as steel. Mounting plates are typically secured to runner 48 and inner surface 52 of mandrel 12 by welding. Mounting plates 50 are secured to the ends of piston 40 by couplings 54. Each coupling 54 may be attached to a corresponding mounting plate 50 by bolts or welding, while being threadably engaged to the outer end of piston 40.

Figure 4:
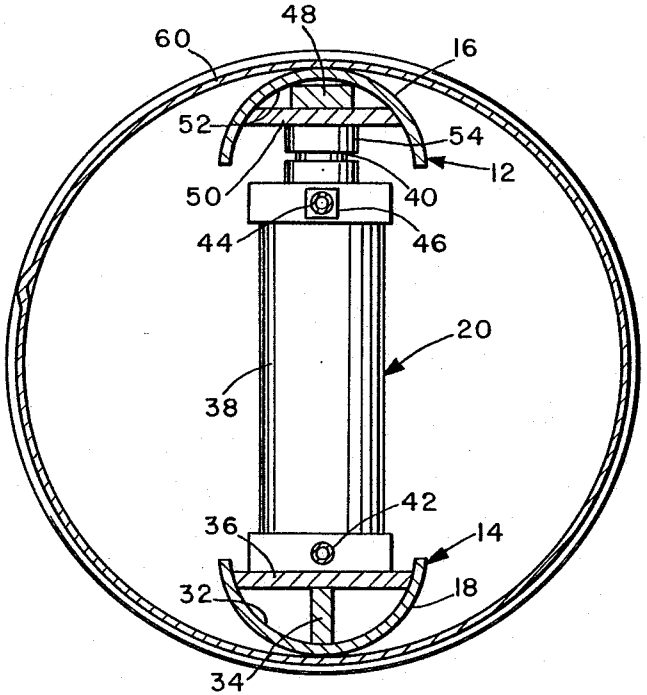
FIG. 4 is an enlarged sectional view taken on line 4—4 of FIG. 2, with the duct in its original configuration.

As illustrated in FIGS. 1 and 4, the concave outer surfaces 16 and 18 of mandrels 12 and 14 are oriented such that they are facing away from one another. The mandrels are positioned in cross-sectional alignment so as to be symmetrical about a common plane which extends through the parallel longitudinal axis of rotation of each mandrel and the axis of extension of each jack piston. The hydraulic jacks uniformly increase the distance between the mandrels through the uniform extension of the piston in each jack. Accordingly, the extension of the mandrels is in a common plane with the mandrels remaining parallel to one another. With mandrel 14 affixed to support frame 22, only mandrel 12 moves, with the mandrel longitudinal axes remaining parallel at all times. By changing the pressure or extension of the jacks, non-parallel relationship may be achieved for certain cases.

Figure 2:
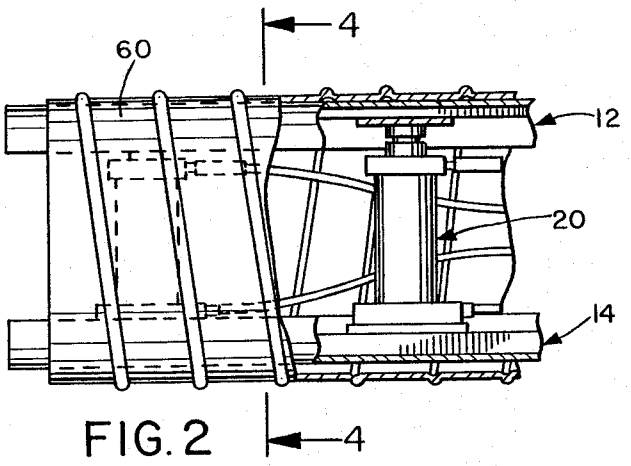
FIG. 2 is a partial side elevation view showing a cylindrical duct in position on the apparatus.

FIG. 2 illustrates pipe stretcher 10 positioned with mandrels 12 and 14 along with jacks 20 positioned within the inside wall of cylindrical spiral ribbed pipe or duct 60. As illustrated in FIG. 2, jacks 20 are relaxed with pistons 40 in the contracted position within cylinders 38. The increase of relative distance between mandrels 12 and 14, caused by jacks 20, deforms the generally circular cross-section of pipe 60 to either an elliptical or oval cross-section.

Figure 3:
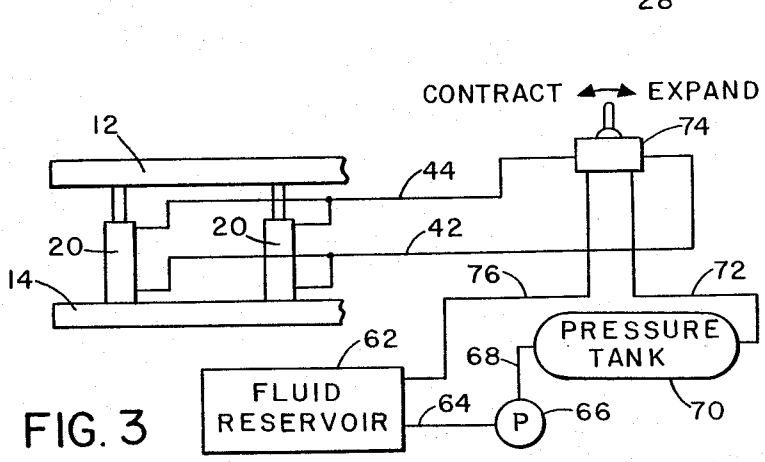
FIG. 3 is a diagram of the control system.

FIG. 3 illustrates by schematical diagram the hydraulic system for stretcher 10. The system is a closed system and controls the expansion and contraction of pistons 40 in cylinders 38. Hydraulic fluid is typically contained in a fluid reservoir 62. Fluid from fluid reservoir 62 is coupled through feed line 64 to the input of pump 66. The hydraulic fluid output from pump 66 is coupled through feed line 68 to pressure tank 70. Pressure tank 70 is coupled by feed line 72 to controller 74.

Controller 74 in one position provides the pressurized hydraulic fluid from tank 70 to feed line 42, feed line 42 being coupled to cylinders 38 of jacks 20. In this state, each piston 40 expands out of the corresponding cylinder. In doing so, the relative distance between mandrels 12 and 14 is increased. The flow of low pressure fluid from cylinder 38 during the expansion of piston 40 is returned through feed line 44 through controller 74 on through feed line 76 to fluid reservoir 62.

To contract pistons 40 from the extended position, controller 74 is placed in the other position. In this state pressurized hydraulic fluid from pressure tank 72 is coupled through controller 74 to feed line 44. Pressurized hydraulic fluid in feed line 44 forces piston 40 of each hydraulic jack 20 into the cylinder 30. In this state, low pressure hydraulic fluid is returned through feed line 42 through controller 74 feed line 76 to fluid reservoir 62.

The hydraulic power unit typically utilized has a 40 gallon fluid reservoir. A hydraulic pump, coupled to a 20 horsepower motor, is typically a compressor piston type pump having a pumping capacity of 10.6 gallons per minute.

FIG. 4 illustrates in an enlarged sectional view taken on line 4—4 of FIG. 2 with the cylindrical spiral ribbed pipe or duct placed over the outer surfaces 16 and 18 respectively of mandrels 12 and 14. As can be seen from FIG. 4, duct 60 is circular in cross-section in its original form.

Figure 5:
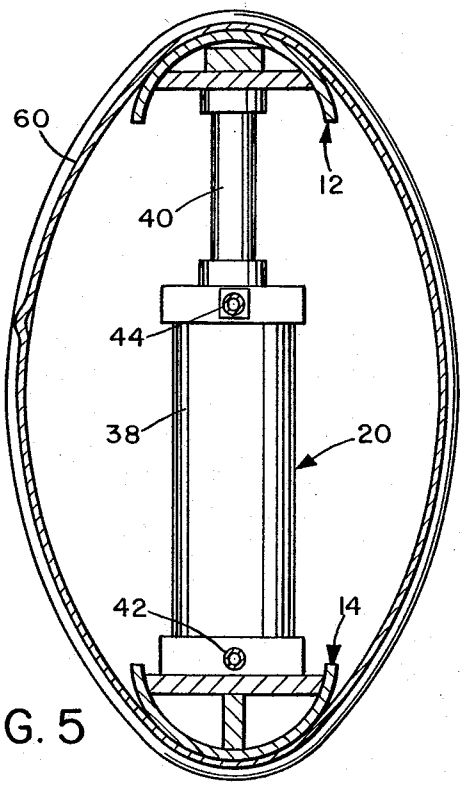
FIG. 5 is a sectional view similar to that of FIG. 4 with the duct partially expanded.

In FIG. 5, piston 40 has extended outward from jack 20 such that mandrel 12 exhibits force on inner wall 78 of duct 60. With mandrel 14 remaining fixed and piston 40 expanding outward, mandrel 12 causes a deformation in the cross-section of duct 60. With piston 40 in a partially extended position, the cross-section of duct 60 is elliptical in appearance.

Figure 6:
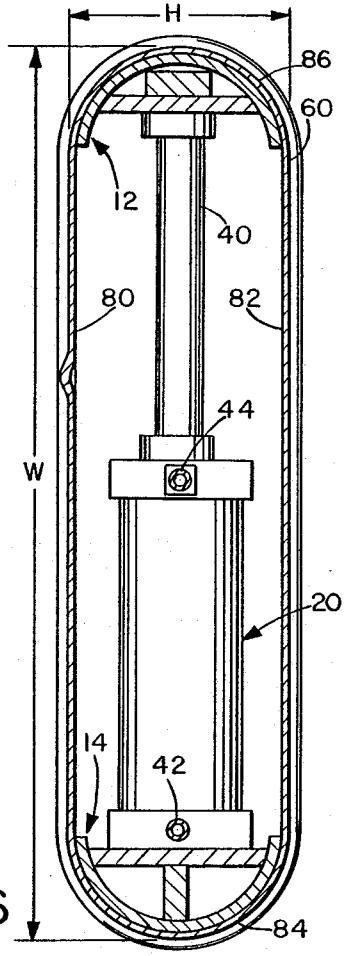
FIG. 6 is a sectional view similar to that of FIG. 4 with the duct fully expanded to a flattened configuration.

In FIG. 6, piston 40 is fully extended from cylinder 38. In the fully extended position of piston, the cross-section of duct 60 is now oval in appearance. Duct 60 now has a pair of parallel side walls 80 and 82 with a width, W, larger than the original diameter of duct 60. Side walls 80 and 82 are intersected by a pair of semicircular end walls 84 and 86. The height, H, defined by the diameter of the end walls is less than the original diameter of the duct 60. Piston 40 is then contracted and duct 60 is removed from the mandrels. Duct 60 retains its oval configuration and may be used in place of standard square or rectangular ducting.

The original duct has less surface area than a rectangular shaped duct for the same amount of cross-sectional area. By stretching the cross-section of the cylindrical duct is conformed into a quasi-rectangular shape by using the quasi-rectangular shaped duct, the reformed duct is used in applications where rectangular duct is used.

Mandrels 12 and 14 are typically constructed of steel and are usually eleven inches in diameter at the outer surfaces. Although mandrels 12 and 14 as described herein are illustrated as being semi-circular in cross-section, mandrels of other diameters and cross-sections may be used. For example, the mandrels may be semi-elliptical, semi-hexagonal, semi-rectangular, or etc. in nature. Using the semi-circular mandrels, an eight inch diameter cylindrical spiral ribbed pipe stretched in an oval configuration may be substituted for a six inch square duct. Other examples of duct is a twenty-eight inch diameter cylindrical duct may be stretched to form the equivalent of a thirty-one inch by twelve inch rectangular duct.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiment shown herein, but is to be accorded the widest scope consistent with the principles and features disclosed herein.

What is claimed is:

1. An apparatus for stretching pipe, comprising:

first and second elongated mandrels having opposite ends, each having a longitudinal axis and an outer surface of a predetermined cross-section transverse to each respective axis for engaging an internal surface of a pipe; and displacement means coupled to said first and second mandrels for adjusting the relative distance between said first and second mandrels by moving at least one of said first and second mandrels with respect to the other, wherein said displacement means comprises a plurality of hydraulic jacks disposed between said first and second mandrels at spaced intervals along the longitudinal extent of the first and second mandrels and between the opposite ends thereof, each jack having a cylinder coupled at one end to an inner surface of said second mandrel and a piston coupled at one end to an inner surface of said first mandrel.

2. The apparatus of claim 1 wherein each mandrel outer surface faces away from the other.

3. The apparatus of claim 1 further comprising support means coupled to said second mandrel for supporting said second mandrel.

4. The appartus of claim 1 further comprising:

source means for generating hydraulic power;

actuator means coupled between said source means and each of said hydraulic jacks for controlling the application of hydraulic power to each of said hydraulic jacks.

5. An apparatus for stretching the wall of a cylindrical pipe transverse to the longitudinal axis of rotation of the pipe wherein said stretched pipe is oval in cross-section, comprising:

a first elongated mandrel having an outer surface substantially concave in cross-section transverse to a longitudinal axis of rotation of said first mandrel and having opposite ends;

a second elongated mandrel having an outer surface substantially concave in cross-section transverse to a longitudinal axis of rotation of said second mandrel and having opposite ends, said first and second mandrel longitudinal axis parallel to one another and said first and second mandrel outer surfaces facing away from one another for contacting opposed portions of an inner surface of a pipe to be stretched; and displacement means coupled to said first and second mandrels for adjusting the relative distance between said first and second mandrels by moving one of said first and second mandrels with respect to the other, wherein said displacement means comprises a plurality of hydraulic jacks disposed between said first and second mandrels at spaced intervals along the longitudinal extent of the first and second mandrels and between the opposite ends thereof, each jack having a cylinder coupled at one end directly to an inner surface of said second mandrel and a piston coupled at one end to an inner surface of said first mandrel.

6. The apparatus of claim 5 wherein said first and second mandrels are each symmetrical aligned about a plane extending through said longitudinal axes of rotation.

7. The apparatus of claim 6 wherein said plurality of hydraulic jacks increases and decreases the relative distance between said first and second mandrels while maintaining a parallel relationship between longitudinal axis of rotation of said first and second mandrels.

8. The apparatus of claim 6 further comprising a support frame secured to one end only of said second mandrel.

9. The apparatus of claim 8 further comprising:

source means for generating hydraulic power;

actuator means coupled between said source means and each of said hydraulic jacks for controlling the application of hydraulic power to each of said hydraulic jacks.

10. The apparatus of claim 9 further comprising flow control means coupled between said actuation means and each of said hydraulic jacks for regulating the flow of hydraulic fluid between said actuator means and each of said hydraulic jacks.

* * * * *